US005181390A

United States Patent [19]

Cavanaugh et al.

[11] Patent Number: 5,181,390

[45] Date of Patent: Jan. 26, 1993

[54] MANUALLY OPERATED REFRIGERANT RECOVERY APPARATUS

[76] Inventors: Wayne B. Cavanaugh, 7818 Adams Rd., Kirkville, N.Y. 13082; Lowell E. Paige, 117 Ennis Ave., Pennellville, N.Y. 13132; Chester D. Ripka, 237 Kinne St., Apt. #3, E. Syracuse, N.Y. 13057

[21] Appl. No.: 816,002

[22] Filed: Jan. 2, 1992

[51] Int. Cl.[5] ..... F25B 49/00

[52] U.S. Cl. ..... 62/126; 62/292; 62/77; 62/149; 62/129

[58] Field of Search ..... 62/77, 85, 149, 195, 62/292, 475, 126, 129

[56] References Cited

U.S. PATENT DOCUMENTS 4,646,527 3/1987 Taylor ..... 62/149

5,127,239 7/1992 Manz et al. ..... 62/292

*Primary Examiner*—John Sollecito

[57] ABSTRACT

A refrigerant recovery device for recovering compressible refrigerant from refrigeration system. The system includes in serial fluid communication, a compressor, a condensor, and a means for storing refrigerant. An expansion device is provided in the fluid line interconnecting the condensor and the storage means. A four way valve is provided which has one port interconnected with the refrigeration system being serviced, another port interconnected with the suction side of the compressor and two additional ports in fluid communication with the means for storing refrigerant. The four way valve may be actuated to recover liquid refrigerant from the refrigeration system being serviced by establishing a first path from the system being serviced directly to the means for storing refrigerant. The four way valve establishes a second path from the means for storing refrigerant, through the four way valve to the compressor, the condensor, and, through the expansion device where high pressure gaseous refrigerant is expanded and delivered to the storage cylinder to thereby cool the cylinder. The four way valve may be actuated to another position wherein the refrigeration system being serviced is in direct fluid communication with the suction port of the compressor to thereby directly recover refrigerant in vapor state from the refrigeration system.

5 Claims, 2 Drawing Sheets

MANUALLY OPERATED REFRIGERANT RECOVERY APPARATUS

BACKGROUND OF THE INVENTION

1. Field of the Invention

This invention relates to refrigerant recovery systems. More specifically, it relates to an arrangement for recovery of refrigerant from a refrigeration system wherein all controls and mode switching are done manually by the operator.

2. Description of the Prior Art

A wide variety of mechanical refrigeration systems are currently in use in a wide variety of applications. These applications include domestic refrigeration, commercial refrigeration, air conditioning, dehumidifying, food freezing, cooling and manufacturing processes, and numerous other applications. The vast majority of mechanical refrigeration systems operate according to similar, well known principals, employing a closed-loop fluid circuit through which a refrigerant flows. A number of saturated fluorocarbon compounds and azeotropes are commonly used as refrigerants in refrigeration systems. Representative of these refrigerants are R-12, R-22, R-500 and R-502.

Those familiar with mechanical refrigeration systems will recognize that such systems periodically require service. Such service may include removal, of, and replacement or repair of, a component of the system. Further during normal system operation the refrigerant can become contaminated by foreign matter within the refrigeration circuit, or by excess moisture in the system. The presence of excess moisture can cause ice formation in the expansion valves and capillary tubes, corrosion of metal, copper plating and chemical damage to insulation in hermetic compressors. Acid can be present due to motor burn out which causes overheating of the refrigerant. Such burn outs can be temporary or localized in nature as in the case of a friction producing chip which produces a local hot spot which overheats the refrigerant. The main acid of concern is HCL but other acids and contaminants can be produced as the decomposition products of oil, insulation, varnish, gaskets and adhesives. Such contamination may lead to component failure or it may be desirable to change the refrigerant to improve the operating efficiency of the system.

When servicing a refrigeration system it has been the practice for the refrigerant to be vented into the atmosphere, before the apparatus is serviced and repaired. The circuit is then evacuated by a vacuum pump, which vents additional refrigerant to the atmosphere, and recharged with new refrigerant. This procedure has now become unacceptable for environmental reasons, specifically, it is believed that the release of such fluorocarbons depletes the concentration of ozone in the atmosphere. This depletion of the ozone layer is believed to adversely impact the environment and human health. Further, the cost of refrigerant is now becoming an important factor with respect to service cost, and such a waste of refrigerant, which could be recovered, purified and reused, is no longer acceptable.

To avoid release of fluorocarbons into the atmosphere, devices have been provided that are designed to recover the refrigerant from refrigeration systems. The devices often include means for processing the refrigerants so recovered so that the refrigerant may be reused. Representative examples of such devices are shown in the following U.S. Pat. Nos. 4,441,330 "Refrigerant Recovery And Recharging System" to Lower et al; 4,476,688 "Refrigerant Recovery And Purification System" to Goddard; 4,766,733 "Refrigerant Reclamation and Charging Unit " to Scuderi; 4,809,520 "Refrigerant Recovery And Purification System" to Manz et al; 4,862,699 "Method And Apparatus For Recovering, Purifying and Separating Refrigerant From Its Lubricant" to Lounis; 4,903,499 "Refrigerant Recovery System" to Merritt; and 4,942,741 "Refrigerant Recovery Device" to Hancock et al.

When most such systems are operating, a recovery compressor is used to withdraw the refrigerant from the unit being serviced. As the pressure in the service unit is drawn down, the pressure differential across the recovery compressor increases because the pressure on the suction side of the compressor becomes increasingly lower while the pressure on the discharge side of the compressor stays constant. High compressor pressure differentials can be destructive to compressor internal components because of the unacceptably high internal compressor temperatures which accompany them and the increased stresses on compressor bearing surfaces. Limitations on the pressure differentials or pressure ratio across the recovery compressors are thus necessary, such limitations, in turn can limit the percentage of the total charge of refrigerant contained within the unit being serviced that may be successfully recovered.

When using such recovery systems in servicing larger refrigeration systems it is particularly advantageous to have the capability of withdrawing refrigerant from the system in the liquid form and delivering it directly to a storage cylinder. The recovery of the refrigerant in liquid form, because of its much greater density, is obviously far quicker than recovery in the vapor state.

Commonly assigned U.S. Pat. No. Ser. No. 612,643 entitled METHOD AND APPARATUS FOR RECOVERING AND PURIFYING REFRIGERANT INCLUDING LIQUID RECOVERY was filed on Nov. 13, 1990. This application discloses an automatically controlled apparatus capable of both recovering and purifying refrigerant. The disclosed device is capable of withdrawing refrigerant in a liquid state directly from a refrigeration system being serviced and delivering the refrigerant to a storage cylinder. This system is also capable of cooling the refrigerant storage cylinder during the liquid recovery mode to lower the pressure and temperature of the storage cylinder below ambient temperature. The system is capable of automatically shifting from a liquid recovery mode to a vapor recovery mode when predetermined conditions in the recovery system are measured.

SUMMARY OF THE INVENTION

It is an object of the present invention to withdraw a refrigerant in its liquid state directly from a refrigeration system being serviced and delivering it to a storage cylinder by use of a manually controlled refrigerant recovery apparatus.

Another object of the invention is to provide a manually controlled recovery apparatus wherein refrigerant in the storage cylinder during liquid recovery may be cooled to lower the pressure and temperature of the storage cylinder below ambient.

It is another object of the invention to manually operate a refrigerant recovery system in a liquid recovery mode and to indicate to the operator when to shift to a vapor recovery mode.

These and other objects are accomplished in a refrigerant recovery device for recovering compressible refrigerant from refrigeration system. The system includes in serial fluid communication, a compressor, a condensor, and a means for storing refrigerant. An expansion device is provided in the fluid line interconnecting the condensor and the storage means. A four way valve is provided which has one port interconnected with the refrigeration system being serviced, another port interconnected with the suction side of the compressor and two additional ports in fluid communication with the means for storing refrigerant. The four way valve may be actuated to recover liquid refrigerant from the refrigeration system being serviced by establishing a first path from the system being serviced directly to the means for storing refrigerant. The four way valve establishes a second path from the means for storing refrigerant, through the four way valve to the compressor, the condensor, and, through the expansion device where high pressure gaseous refrigerant is expanded and delivered to the storage cylinder to thereby cool the cylinder. The four way valve may be actuated to another position wherein the refrigeration system being serviced is in direct fluid communication with the suction port of the compressor to thereby directly recover refrigerant in vapor state from the refrigeration system.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will be best understood from the following description of the preferred embodiment when read in connection with the accompanying drawings wherein:

DESCRIPTION OF THE PREFERRED EMBODIMENT

Figure 1:
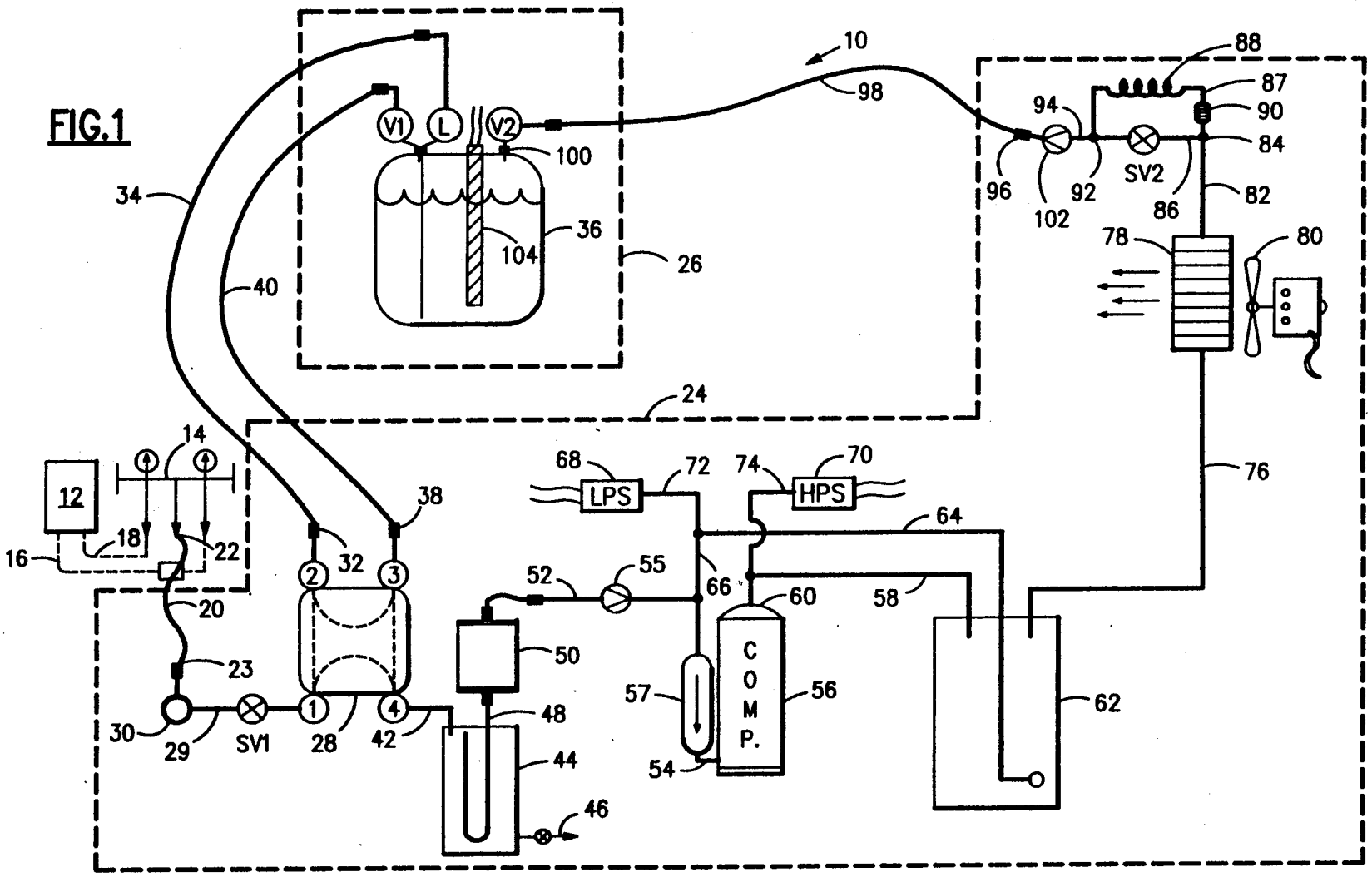
FIG. 1 is a diagrammatical representation of a refrigerant recovery apparatus embodying the principals of the present invention.

An apparatus for recovering refrigerant from a refrigeration system is generally shown at reference numeral 10 in FIG. 1. The refrigeration system to be evacuated is generally indicated at 12 and may be virtually any mechanical refrigeration system.

As shown, the interface between the recovery system 10 and the system being serviced 12 is a standard gauge and service manifold 14. The manifold 14 is connected to the refrigeration system to be serviced in a standard manner with one line 16 connected to the low pressure side of the system and another line 18 connected to the high pressure side of the system. A flexible high pressure refrigerant line 20 is interconnected between the service connection 22 of the service manifold and an appropriate coupling 23 forming a part of the recovery unit 10.

The recovery system 10 includes two sections, as shown in FIG. 1, the components and controls of the recovery system are contained within a self-contained compact housing (not shown) schematically represented by the dotted line 24. A refrigerant storage section of the system is contained within the confines of the dotted lines 26. The details of each of these sections and their interconnection and interaction with one another will now be described in detail.

From the coupling 23, a refrigerant line 29 extends to port number 1 of a four-way valve 28. The refrigerant line 29 includes a sight glass 30 and an electrically actuated solenoid valve identified as SV1.

The four-way valve 28 is a manually operated valve which for purposes of the invention is operable in only two positions. In a first position, port number 1 is connected to port number 2 and port number 3 is connected to port number 4. In a second position, port number 1 is connected to port number 4 and port number 2 is connected to port number 3.

Port number 2 of the four-way valve 28 is connected via a coupling 32 to a flexible liquid refrigerant line 34 which extends to the refrigerant storage section of the system 26 where it communicates with a refrigerant storage cylinder 36. Port number 3 of the four-way valve 28 is also interconnected with the storage cylinder 36 via its own coupling 38 and refrigerant line 40.

Port number 4 of the four-way valve 28 is interconnected via refrigerant line 42 to the inlet of a combination accumulator/oil trap 44, having an oil drain arrangement 46. The oil trap 44 in turn is connected via conduit 48 to an acid purification filter-dryer 50 where impurities such as acid, moisture, foreign particles and the like are removed before refrigerant is conducted via conduit 52 to the suction port 54 of a compressor 56. A suction line accumulator 57 is disposed in the conduit 52 to assure that no liquid or refrigerant passes to the suction port 54 of the compressor. The compressor 56 is preferably of the rotary type, which are readily commercially available from a number of compressor manufacturers, but may be of any type such as reciprocating, scroll or screw. The conduit 52 also includes a check valve 55 which allows flow only in the direction from the filter-dryer 50 to the compressor.

A refrigerant line 58 establishes fluid communication between the compressor discharge port and a conventional float operated oil separator 62. In the separator oil from the recovery system compressor 56 is separated from refrigerant passing thereto and is directed via float controlled return line 64 to the conduit 66 which in turn communicates with conduit 52 and returns the separated oil to the compressor 56.

It will be noted that a low pressure switch 68 and a high pressure switch 70, are operatively connected via conduits 72 and 74, respectively, with the low and high pressure sides, respectively, of the compressor 56.

The outlet of the oil separator 62 is interconnected via conduit 76 to the inlet of a heat exchanger/condenser coil 78. An electrically actuated condenser fan 80 is associated with the coil 78 to direct the flow of ambient air across the coil as will be described in connection with operation of the system.

From the outlet of the condenser coil 78 an appropriate conduit 82 conducts refrigerant to a T-connection 84. From the T 84, one conduit 86 passes to another electrically actuated solenoid valve SV2, while the other branch 87 of the T passes to a suitable refrigerant expansion device 88. In the illustrated embodiment, the expansion device 88 is a capillary tube and a strainer 90 is disposed in the refrigerant line 87 upstream from the capillary tube to remove any particles which might potentially block the capillary. It should be appreciated that the expansion device could comprise any of the other numerous well known refrigerant expansion devices which are widely commercially available. The conduit 87, containing the expansion device 88, and the conduit 86, containing the valve SV2, rejoin at a second T-connection 92 downstream from both devices. It should be appreciated that the solenoid valve SV2 and the expansion device 88 are in a parallel fluid flow relationship. As a result, when the solenoid valve SV2 is open, the flow of refrigerant will be, because of the high resistance of the expansion device, through the solenoid valve in a substantially unrestricted manner. On the other hand, when the valve SV2 is closed, the flow of refrigerant will be through the high resistance path provided by the expansion device. Combination devices such as electronically actuated expansion valves are known, which would combine the functions of the valves SV2 and the capillary tube 88, however, as configured and described above, the desired function is obtained at a minimum cost.

From the second T-92, a conduit 94 passes to an appropriate coupling 96 for connection of the system as defined by the confines of the line 24, via a flexible refrigerant line 98 to another inlet port 100 of the previously referred to refrigerant storage container 36. A check valve 102 is disposed in the refrigerant line 94 which allows refrigerant to flow only in the direction from second T-92 in the direction of the refrigerant storage cylinder 36.

The refrigerant storage cylinder 36 further includes a liquid level indicator 104. The liquid level indicator, for example, may comprise a compact continuous liquid level sensor of a type available form Imo Delaval Inc., Gems Sensors Division. Such an indicator is capable of providing a electrical signal indicative of the level of the refrigerant contained within the storage cylinder 36. This signal may be used to terminate a refrigerant recovery operation in order to avoid over filling of the refrigerant storage cylinder 36.

Figure 2:
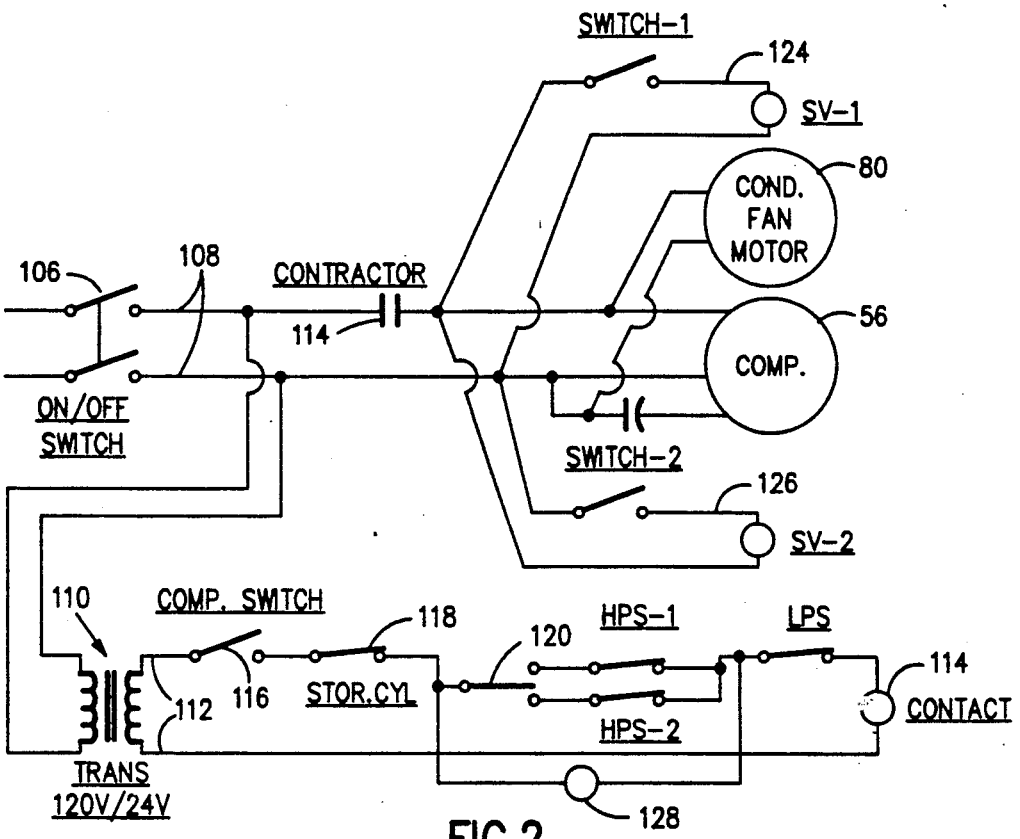
FIG. 2 is an electrical control wiring diagram for the apparatus of FIG. 1.
Figure 3:
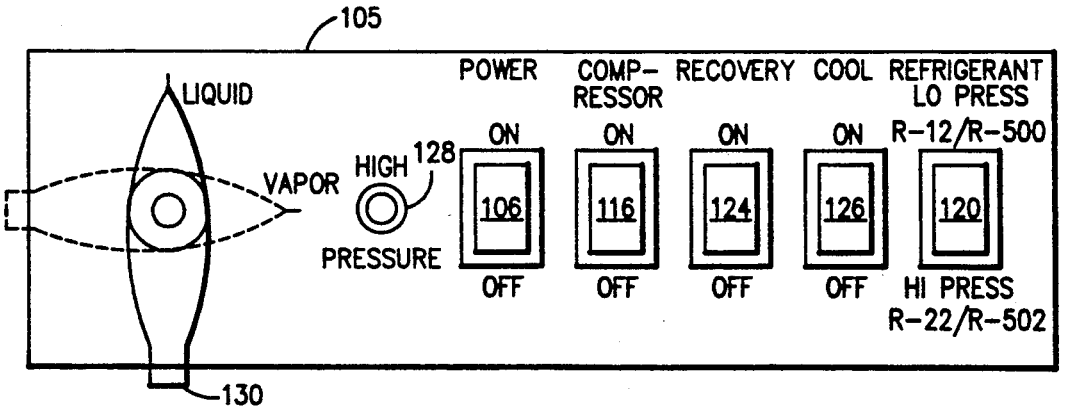
FIG. 3 is a simplified showing of the control console of the apparatus of FIG. 1.

FIG. 2 illustrates a schematic electrical control wiring diagram for control of the refrigerant recovery unit 10. This circuit will be described in connection with FIG. 3 which shows the control switch layout on the console 105 of a refrigerant recovery unit incorporating the principals of the present invention. FIGS. 2 and 3 will be described in conjunction with one another and with reference to the components as illustrated in FIG. 1. Referring now to FIG. 2, single phase 120 volt AC power is provided to an on/off switch 106, which is located on the console as seen in FIG. 3. The on-off switch 106 controls power to all components of the system. When the on/off switch is in the "on" position 120 volt power is provided via wires 108 to the primary side of a transformer 110 having a 24 volt secondary output 112. Located on one side of the 24 volt output are a series of control and protective switches all of which must be closed in order to supply power to the motor contactor 114.

The first of these switches is identified as the compressor switch 116, this switch is physically located on the console 105. The next is identified as the storage cylinder switch 118. The switch 118 is adapted to receive a signal from the liquid level indicator 104 or other storage cylinder protective device contained in the storage cylinder to prevent over filling of the compressor. When the liquid level indicator 104 provides a signal indicative of impending overfill of the storage cylinder, the switch 118 will open and the system will not be allowed to run until the cylinder is replaced with an empty cylinder or refrigerant is removed from the cylinder.

Referring now specifically to FIG. 2 it will be noted that two high pressure switches, i.e. HPS-1 and HPS-2 are shown in parallel in the transformer secondary control circuit. These two high pressure switches are represented generally by the reference numeral 70 in FIG. 1. Two high pressure switches are provided in order to allow the recovery system to operate safely and efficiently with a wide range of refrigerants. Specifically, in a unit embodying the present invention the first high pressure switch i.e. HPS-1 is designed to have a higher pressure cut out in order to allow the system to operate with higher pressure refrigerants such as R-22 and R-502. Such refrigerants at high ambient temperatures could be expected to produce condensing pressures within the system in the neighborhood of 300 psia and accordingly the high pressure HPS-1 switch is selected to have an opening threshold of 300 psia. The second high pressure switch HPS-2 is designed to allow safe effective operation with lower pressure refrigerants such as R-12 and R-500, such refrigerants could be expected to have maximum condensing pressures at high ambient temperatures in the neighborhood of 200 psia and accordingly the switch is designed to open at such pressure.

The switch located to the left of the high pressure switches is the refrigerant selection switch 120 and is identified on the console as the refrigerant switch. As will be seen with reference to the switch on the console when the upper portion of the switch is depressed the operator has selected low pressure refrigerants and the second HPS-2 switch will be in the circuit, and, likewise when the lower portion of the switch is depressed the high pressure HPS-1 switch will be operating in the circuit. The low pressure cut-off switch 122 illustrated in FIG. 2 is designed to interrupt the system when extremely low compression suction pressures are detected in order to protect the compressor as will be understood as the operation of the system continues.

With continued reference to FIGS. 2 and 3 switch 124 identified on the console as the "recovery" switch is identified as switch 1 in FIG. 2 and is the switch which opens the solenoid valve SV1. Similarly the switch 126 identified on the console as "cool" is switch 2 in FIG. 2 and actuates solenoid valve SV2.

It will be noted that the console is provided with a high pressure warning light 128. This light is illustrated in FIG. 2 and is wired across the refrigerant selection switch 122 and the two high pressure switches HPS-1 and HPS-2 and will light up or glow when either of the high pressure switches has opened in order to indicate to the operator that the system has shut down due to opening of which ever of the high pressure switches is in the circuit and has opened.

Also located on the console 105 is the lever 130 for shifting the four-way valve 28 between its two previously indicated operating positions.

Operation of the system to remove first liquid refrigerant, and, then vapor state refrigerant from a refrigeration system to be serviced will now be described in detail. At this point it is assumed that the system has been coupled to the system 12 to be serviced as described hereinabove for withdrawal through the flexible refrigerant line 20. The user of the device is instructed to place the four-way valve lever 128 in the position shown in FIG. 3 pointing to the word "liquid" on the console. This places the four-way valve 28 in the first described position with port number 1 connected to port number 2 and port number 3 connected to port number 4. The refrigerant selection switch 120 is then pressed according to what refrigerant is being recovered to place the appropriate high pressure switch into the control circuit.

However switch 106 is then actuated and the compressor, recovery, and cool switches 116, 124 and 126 respectively, are all based on the on condition. At this point solenoid valve SV1 has been opened by actuation of the recovery switch 124, and, solenoid valve SV2 has been closed, and, the condensor fan and compressor motors are actuated.

Given these conditions, liquid refrigerant passes from the refrigeration system 12 via conduits 20 and 29 through the four-way valve 28 exiting at port 2 and passing through liquid refrigerant line 34 directly to the refrigerant storage cylinder 36.

Upon entering the storage cylinder 36 at ambient conditions, a portion of the liquid refrigerant will exist in gaseous form. At this time the ports 3 and 4 of the four-way valve 28 are in fluid communication and fluid path is directly established between line 40 of the storage cylinder 36 and the conduit 42 which is in communication with the low pressure side of the compressor 56. Accordingly, with the system controls as described above, during liquid recovery, the compressor 56 acts to withdraw low pressure gaseous refrigerant directly from the storage cylinder 36. This refrigerant passes via conduit 40 through the four-way valve 28 and conduit 42 to the oil separator 44. From the oil separator it passes via conduit 48 to the filter dryer 50, and thence, via conduit 52 and accumulator 57 to the compressor 56. The compressor then delivers high pressure gaseous refrigerant via conduit 58 to the oil separator 62. From the oil separator 62 the high pressure gaseous refrigerant passes via conduit 76 to the condenser coil 78 where the hot compressor gas condenses to a liquid.

Liquified refrigerant leaves the condenser coil 78, via conduit 82 and passes through the T-connection 84, through the strainer 90, and, via conduit 87 to the refrigerant expansion device 88. The thus condensed refrigerant, at a high pressure, flows through the expansion device 88 where the refrigerant undergoes a pressure drop, and is at least partially flashed to a vapor. The liquid-vapor mixture then flow via conduits 94 and 98 back to the refrigerant storage cylinder 36 where it evaporates and absorbs heat from the refrigerant within the cylinder thereby lowering the pressure and temperature within the storage cylinder 36. As a result of the lowered temperature and pressure within the cylinder the pressure differential between the refrigeration system being serviced 12, which is at ambient temperature, and the storage tank 36 is substantially increased, and, as a result the flow of liquid refrigerant through the liquid refrigerant line 34 to the storage cylinder is substantially increased.

During this liquid recovery mode of operation the user is directed to observe the flow through the sight glass 30 in the refrigerant line 29. For as long liquid refrigerant is being withdrawn from the system bubbles will appear in the sight glass. When no bubbles appear in the sighted glass and the sightee glass is substantially clear it is an indication that vapor is now being withdrawn from the refrigeration system 12. At this point, the user is directed to switch the system to the vapor recovery mode of operation. This accomplished by moving the four-way valve lever 130 to the "vapor" position thereby placing the valve in its second described position wherein port 1 is connected to port 4 and port 2 is connected to port 3. At this point, the "cool" switch is also placed in the off position and solenoid valve SV2 is thereby opened to provide a bypass to the refrigerant expansion device 88. The device then operates to automatically withdraw refrigerant in the vapor state from the refrigeration system 12 via conduits 20 and 29 to the four-way valve 28 and from port 4 of the four-way valve through the circuit described hereinabove, with the exception that it passes through the open solenoid valve SV2, directly to the storage cylinder 36.

The system will continue to operate until it is shut down by one of two events. If it is shut down by the opening of the low pressure switch 122 the recovery operation is complete. In an actual system incorporating the present invention the low pressure switch is set at approximately zero psig or slightly below.

If the system shuts off automatically as a result of the opening of the high pressure switch the high pressure pilot light 128 on the console will glow and the user is instructed that the system has not drawn as much refrigerant from the system 12 as it is capable of withdrawing however, the discharge pressure of the compressor is such that the system should be operated in a storage cylinder cooling mode in order to reduce the temperature of the refrigerant stored in the container and accordingly reduce the discharge pressure of the compressor. This is accomplished by placing the recovery switch 124 in the "off" position to thereby close solenoid valve SV1 and putting the cooling switch 126 in the "on" position to thereby close solenoid valve SV2. The four-way valve lever 130 is moved back to position 1 to thereby interconnect ports 3 and 4.

At this point the system is operating in a closed circuit with refrigerant vapor being withdrawn from the cylinder 36 via conduit 40 passing through the four-way valve 28 and exiting from port 4, passing sequentially through the oil separator 44, the filter drier 50, the compressor 56, the oil separator 62, the condenser coil 78, through the refrigerant expansion valve 88 and thence returning to the storage cylinder. Then the refrigerant expands and cools the cylinder and the refrigerant contained therein. The operator is directed to run the system in the cylinder cool mode for up to a maximum time of fifteen minutes at which time the temperature within the storage cylinder 36 will be substantially below ambient temperature.

At this point, the operator is directed to put the system back into the vapor recovery mode by actuating switch 126 to open the solenoid valve SV2, and returning the four-way valve to position 2 to interconnect port 1 and port 4. At this point in time, because of the extremely low temperature in the storage cylinder, the system is now capable of withdrawing additional vaporous refrigerant from the unit being serviced, without subjecting the recovery compressor 56 to high pressure differentials.

An understanding of this phenomenon will be appreciated with reference to FIG. 1. It will be described by picking up a recover cycle which is being performed following a cylinder cool cycle at the point where refrigerant withdrawn from the system being serviced is discharged from the compressor 56 and is passing, via conduit 76 to the condenser 78. At this point, the pressure within the system, extending from the compressor discharge port 60 through, and including, the storage cylinder 36 is dictated by the temperature and pressure conditions within the storage cylinder 36. As a result the storage cylinder now effectively serves as a condenser with the recovered refrigerant passing as a super-heated vapor through the condenser coil 78, (which is at ambient temperature)through the solenoid valve SV2 and the conduits 94 and 98 to the storage cylinder 36 where it is condensed to liquid form. At this point, the user is directed to allow the system to run until the low pressure switch shuts off and recovery is complete as described above.

What is claimed:

1. Apparatus for recovering compressible refrigerant from a refrigeration system comprising:

compressor means for compressing gaseous refrigerant delivered thereto, said compressor means having a suction port and a discharge port;

condenser means for passing refrigerant therethrough, said condenser means having an inlet and an outlet;

means for storing refrigerant;

a first valve means having a first port, a second port, a third port, and, a fourth port, said first valve means being operable to a first condition, wherein said first port is in fluid communication with said second port, and, said third port is in fluid communication with said fourth port, and to a second condition wherein said first port is in fluid communication with said fourth port;

first conduit means for connecting the refrigeration system with said first port of said first valve means;

second conduit means for connecting said second port of said first valve means with said means for storing refrigerant;

third conduit means for connecting said third port of said first valve means with said means for storing refrigerant;

fourth conduit means for connecting said fourth port of said first valve means with said suction port of said compressor;

fifth conduit means for connecting said discharge port of said compressor with said inlet of said condenser;

sixth conduit means for connecting said outlet of said condenser with said means for storing refrigerant; and second valve means operable between an open condition and a refrigerant expanding condition, disposed in said sixth conduit;

whereby when said first valve means is in said first condition, and, said second valve means is operated to said expanding condition and, said compressor means is operating, refrigerant will be withdrawn from the refrigeration system and delivered to said means for storing refrigerant by way of said first conduit, said first and second ports of said first valve means and said second conduit; and wherein a closed refrigeration circuit is defined by said means for storing refrigerant, said third conduit means, said ports three and four of said first valve means, said fourth conduit means, said compressor, said fifth conduit means, said condenser means and, said sixth conduit means, back to said means for storing refrigerant;

whereby refrigerant flowing through the closed refrigeration circuit passes through said second valve means and expands and passes to the storage means where it evaporates to reduce the temperature and pressure within the means for storing.

2. The apparatus of claim 1, further including means for purifying refrigerant, disposed in said fourth conduit means.

3. The apparatus of claim 1, further including third valve means disposed in said first conduit, said third valve means being operable between open and closed conditions.

4. The apparatus of claim 1, further including means for determining the discharge pressure of said compressor, and, for interrupting power to said compressor when the discharge pressure exceeds a predetermined value.

5. The apparatus of claim 4, further including a second means for determining the discharge pressure of said compressor and for interrupting power to said compressor when the discharge pressure exceeds a second higher predetermined value.

* * * * *